United States Patent [19]

Pizzi

[11] 3,980,265

[45] Sept. 14, 1976

[54] SEWING MACHINE TABLE ACCESSORY SHELF

[75] Inventor: Dominick Pizzi, Jersey City, N.J.

[73] Assignee: Lawrence Peska Associates, Inc., New York, N.Y. ; a part interest

[22] Filed: Aug. 21, 1975

[21] Appl. No.: 606,468

[52] U.S. Cl. ..... 248/240.4; 297/417; 312/281

[51] Int. Cl.[2] ..... A47G 29/02; E04G 3/08

[58] Field of Search ..... 312/248, 281, 240.1; 248/240.4; 297/155, 161, 162, 417

[56] References Cited

UNITED STATES PATENTS

| | | | |
|---|---|---|---|
| 2,150,721 | 3/1939 | Mullooly | 297/155 |
| 3,371,798 | 3/1968 | Daltrui | 248/240.4 |
| 3,838,841 | 10/1974 | Cadman | 248/240.4 |

*Primary Examiner*—Casmir A. Nunberg

[57] ABSTRACT

This disclosure pertains to a retractable shelf attachment fastened to a sewing machine table to be used to support quantities of precut fabric parts in a convenient location to the operator. The shelf has a vertical storage position along one short side of the sewing machine table. The track, fastened to the short end of the sewing machine table, supports an internal slide, which in turn, supports a vertical bar depending downward therefrom. The lowermost free end of the vertical bar is adapted with a component of a detent mechanism. In use, the operator pulls the slide to its frontmost position, which is located near the foremost longitudinal edge of the sewing machine table, transporting the vertically positioned underslung shelf. Ninety degree rotation of the shelf about a horizontal axis permits the detenting mechanism to lock the shelf's surface in a plane parallel to the floor.

5 Claims, 5 Drawing Figures

SEWING MACHINE TABLE ACCESSORY SHELF

BACKGROUND OF THE INVENTION

1. The Field of the Invention

This invention relates to stands, worktables, work stools, shelves, or the like which are used to support stacks of precut pieces of fabric in a convenient location to the operator of a sewing machine. Large fabric work pieces can overhang the sewing machine table and similarly require a supporting surface to prevent contact with the floor.

2. Description of the Prior Art

The prior art includes retractable shelves which are stored slightly below the uppermost surface of the table. Other schemes include shelves hingeably mounted in drop-leaf fashion which pivot from the vertical position about an axis parallel to one edge of the table. Other refinements include horizontably extensible surfaces adapted with supporting legs and built-in storage compartments.

SUMMARY OF THE INVENTION

A shelf accessory for a sewing machine table which is stored, when not in use, vertically alongside and below one side edge of the table. Means are provided to extend the shelf, while lying in a vertical plane, along a track parallel to the side edge of the table, until the shelf is fully extended from beneath the table top. When the shelf is in the fully extended position, a detent mechanism permits rotataion of the rotation into a locked horizontal operable position. The ultimate position at which the shelf is to be used places the shelf forward of the front longitudinal edge of the table nearest the sewing machine operator and maintains the shelf in a horizontal plane disposed somewhat lower than the surface of the sewing machine table.

A primary object of the instant invention is to provide an accessory shelf for use with a sewing machine table conveniently stored in a vertical plane alongside and below one side edge of the table.

Another object is to provide a detenting means to maintain the shelf, when in the stored position, in a vertical plane.

Still another object is to provide simple guidance means to permit the shelf to be easily withdrawn from its storage position.

A further object is to provide detenting means to maintain the shelf in a horizontal use position when the shelf is fully withdrawn.

Another object is to provide that the surface of the shelf, when horizontal, is disposed below the uppermost surface of the sewing machine table.

Still another object is to provide an accessory shelf which does not store horizontally beneath the lowermost surface of the sewing machine table, thus providing ready access to the sewing machine and associated devices.

A further object is to provide a shelf which extends partially beyond the width of the sewing machine table.

Another object is to provide an accessory shelf whose finished uppermost work surface is protected from accidental damage when in the vertical stored position.

Still another object is to provide an accessory shelf device which does not confine or limit the space occupied by the operator when the shelf is stored.

A further object is to provide an accessory shelf which is positioned close to the operator's elbow when the shelf is placed in the operable position.

Another object is to provide for a convenience shelf which can be mounted on either or both sides of a sewing machine table.

These objects, as well as other objects, of this invention will become readily apparent after reading the following description of the accompanying drawings.

DESCRIPTION OF THE PREFERRED EMBODIMENT

The structure and method of fabrication of the present invention is applicable to a retractable sewing machine convenience shelf which is stored in a vertical position below and alongside one side edge of a sewing machine table. A horizontal track is permanently affixed to a side edge of the table. A sliding member is captured in the track and is limited in its travel along the entire length of the track by pins which traverse the cavity in the track in which the slide travels. The pins are located near each free end of the track. The slide supports a rectangular L-shaped bar-shaped member downwardly in a vertical position. A horizontal detent pin, whose axis is parallel to the axis of the track, has a portion of its length square-like in cross-section, nonrotatably affixed to the L-shaped supporting member near its free end. One edge of the shelf has a detent plate, at right angles to the shelf's surface, extending below the shelf, when the shelf is in a horizontal position. The plate is adapted with a transverse cutout section, substantially W-shaped in appearance, such that each free end of the cutout section is a rectangle, whose width is slightly greater than the length of a side of the square portion of the detenting pin. The long sides of the rectangular terminations of the W-shaped cutout are ninety degrees apart. In use, the shelf is stored in a vertical plane and is so maintained by the square cross-section of the horizontal pin engaging the end of a rectangularly-shaped cutout. The shelf is extended along a horizontal path out from under the track as the slide travels horizontally along the track's length. When the slide reaches its extreme forwardmost position, the shelf is capable of being rotated counterclockwise about the axis of the pin into a horizontal position if the track is mounted on the side edge of the table to the right of the operator. The pin's square cross-section traverses the excursion of the W-shaped slot and terminates at the other free end of the slot which maintains the shelf in a horizontal plane. The shelf is now fully withdrawn from beneath the table and is horizontally disposed somewhat below the table's uppermost surface, ready for use.

Figure 1:
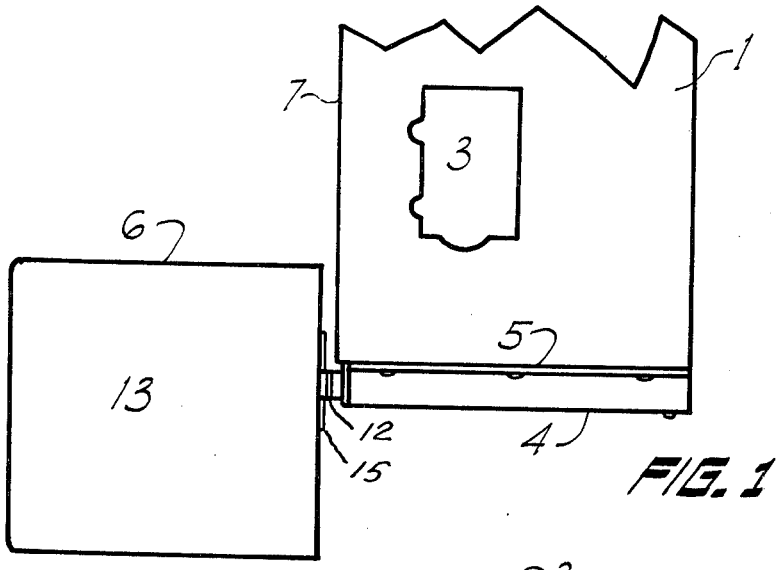
FIG. 1 is a plan view of a portion of a sewing machine table illustrating the accessory shelf locked in the horizontal extended position.

Now referring to the Figures, and more particularly to the embodiment illustrated in FIG. 1 showing a fragmentary portion of the sewing machine table top 1 in plan view. The sewing machine 3 is located atop the table 1 in a position which is convenient to the operator, not shown. Track 4 is affixed to the vertical plane 5 defining the right side edge of the table. The shelf 6 is shown in the horizontal position extended slightly forward of longitudinal edge 7, which is closest to the operator. Shelf 6 is shown at the operator's right when the operator faces the sewing machine 3. The surface 13, of the shelf 6, is uppermost and is used to support the fabric. Plate 15 affixed to shelf 6, pivots about a horizontal detenting pin 12 so as to permit shelf 6 to be maintained in the horizontal position shown, or in a vertical position adjacent vertical plane 5.

Figure 2:
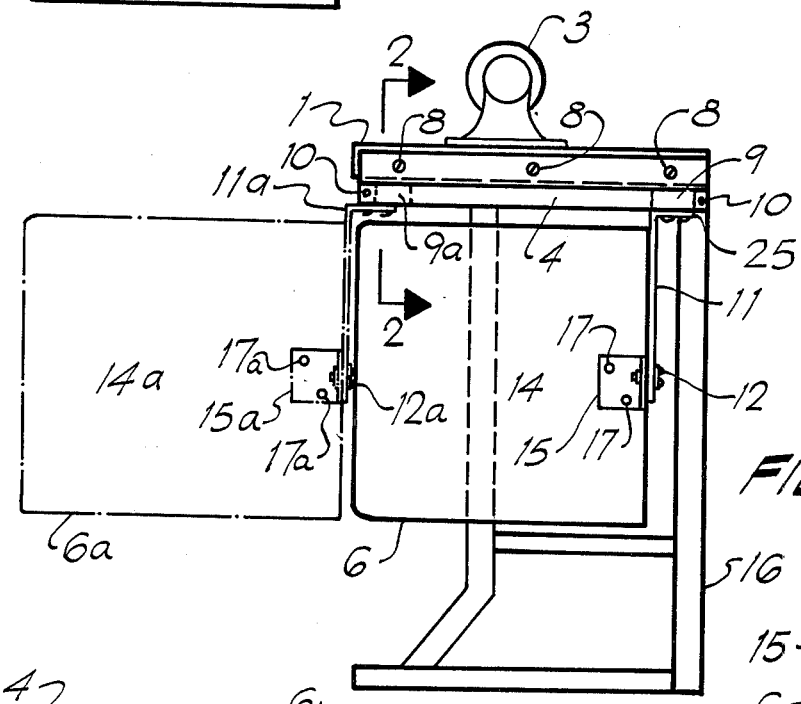
FIG. 2 is a side elevation view showing a sewing machine mounted on a table and stand. The shelf is illustrated in its stored and withdrawn positions.

FIG. 2 illustrates the sewing machine table 1 with the sewing machine mounted thereto. Track 4 is fastened to the side of the table by screws 8. A slide 9, illustrated in phantom, is within the track near the end at the right. Pins 10 confine the slide's location to any position intermediate the ends of the track. A rectangular bar-shaped member 11, is bent into L-shape, and has its short leg 25 fastened to the lowermost surface of the slide. The slide is preferably made of plastic or some other virtually frictionless material, facilitating effortless gliding FIG. 2 illustrates the sewing machine table 1 with the sewing machine mounted thereto. Track 4 is fastened to the side of the table by screws 8. A slide 9, illustrated in phantom, is within the track near the end at the right. Pins 10 confine the slide's location to any position intermediate the ends of the track. A rectangular bar-shaped member 11, is bent into L-shape, and has its short leg 25 fastened to the lowermost surface of the slide. The slide is preferably made of plastic or some other virtually frictionless material, facilitating effortless gliding within the track's cavity. Affixed non-rotatably to the rectangular bar-shaped member 11 near the lowermost free end is the horizontal detenting pin 12. The surface 14 of the shelf is intended to be lowermost when the shelf is in the horizontal position and has a L-shaped detent plate bracket 15 fastened to the surface by bolts 17. Stand 16 supports the sewing machine table top and all the devices affixed thereto. The shelf 6 is capable of being transported to a forwardmost position depicted in phantom by the numeral 6*a*.

Figure 3:
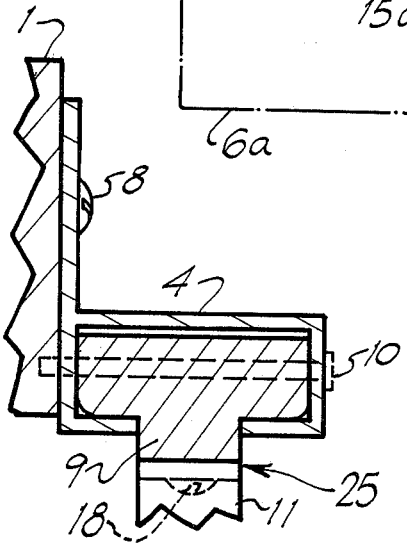
FIG. 3 is a cross-sectional view of a fragmented portion of a table, track, internal slide, stop pin assembly, and a fragmented portion of a shelf supporting member taken along line 2—2 viewed in the direction of arrows 2—2.

FIG. 3 is a cross-sectional view of a fragmentary portion of the table top 1, the track 4, the inner slide 9, a fragmentary portion of the rectangular bar-shaped member 11, a track cavity traversing pin 10, shown in phantom, which is behind the inner slide member 9. Bolt 18 fastens the short leg 25 of the rectangular supporting member 11 to the lowestmost surface of the inner slide 9 which has a T-shaped cross-section.

Figure 4:
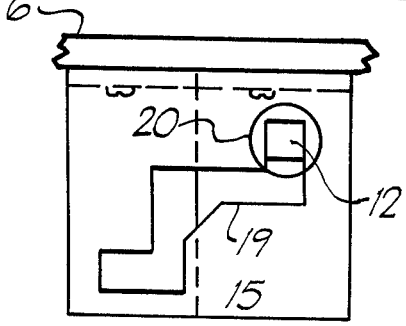
FIG. 4 is a side elevation view of the broad surface of the detenting plate affixed to a fragmentary portion of the shelf.

FIG. 4 illustrates the vertical surface of the detent plate bracket 15 with a W-shaped slot 19 cut through it. Each end of the W-shaped slot terminates in a portion which is rectangular in shape. Washer 20 encircles the protruding square-shaped horizontal pin 12. Upon lifting the shelf 6 and the detent bracket 15 slightly upward, pin 12 engages the lowermost horizontal edge of the slot. Pushing the table and detent plate assembly 15 to the right allows the square pin 12 to come into contact with a vertical edge of the slot. The table is rotated at this point, permitting the square pin 12 to enter the horizontal leftmost rectangular leg of the slot. Now the shelf's surface lies in a vertical plane as shown in FIG. 2. The shelf is allowed to drop slightly until the square pin engages the end of the rectangular slot in which it is located.

Figure 5:
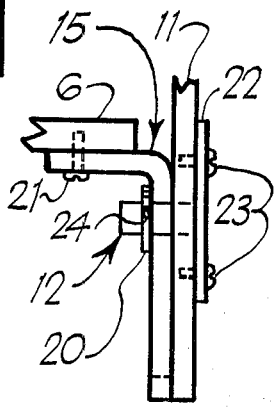
FIG. 5 is a side elevation view illustrating a fragmentary portion of the shelf, detenting plate, a fragmentary portion of the vertical bar-shaped supporting member, and a horizontal detenting pin and washer assembly.

FIG. 5 illustrates the detent plate bracket 15 fastened to the undersurface of the shelf 6 by screw 21. The square pin 12 is immovably pressed into a mounting plate 22. Mounting plate 22 is fastened to the rectangular bar-shaped member 11 near its lowestmost free end by screws 23. Square pin 12 passes through a square opening in rectangular bar-shaped member 11, and through the slot in the leg of detenting plate 15 transverse to the shelf 6. Washer 20 maintains parallel interface engagement between the rectangular bar-shaped member 11 and the vertical surface of the detenting plate bracket 15. Set screw 24 locks washer 20 onto pin 12.

One of the advantages is an accessory shelf for use with a sewing machine table conveniently stored in a vertical plane alongside and below one side edge of the table.

A further advantage is a detenting means to maintain the shelf, when in the stored position, in a vertical plane.

Another advantage is simple guidance means to permit the shelf to be easily withdrawn from its storage position.

Still another advantage is detenting means to maintain the shelf in a horizontal use position when the shelf is fully withdrawn.

A further advantage is that the surface of the shelf, when horizontal, is disposed below the uppermost surface of the sewing machine table.

Another advantage is an accessory shelf which does not store horizontally beneath the lowermost surface of the sewing machine table, thus providing ready access to the sewing machine and associated devices.

Still another advantage is a shelf which extends partially beyond the width of the sewing machine table.

A further advantage is an accessory shelf whose finished uppermost work surface is protected from accidental damage when in the vertical storage position.

Another advantage is an accessory shelf device which does not confine or limit the space occupied by the operator when the shelf is stored.

Still another advantage is an accessory shelf which is positioned close to the operator's elbow when the shelf is placed in the operable position.

A further advantage is a convenience shelf which can be mounted on either or both sides of a sewing machine table.

Thus, there is disclosed in the above description and in the drawings, an embodiment of the invention which fully and effectively accomplish the objects thereof. However, it will be apparent, to those skilled in the art, how to make variations and modifications to the instant invention. Therefore, this invention is to be limited not by the specific disclosure herein, but only by the appending claims.

The embodiment of the invention in which an exclusive privilege or property is claimed are defined as follows:

1. A sewing machine table accessory shelf comprising a longitudinal track fastened horizontally at a side end of a sewing machine table, a longitudinal slot extending the entire length of the lowermost surface of a cavity in said track, said cavity extending the length of said track, a slidable support member within said cavity substantially shorter than the entire length of said track, an L-shaped bracket having a leg depending vertically downwards from the lowermost surface of said slidable support member, a right angle detenting bracket fastened at one edge on the surface of a shelf, a square pin transverse to said vertical leg of said L-shaped bracket located near the free end thereof, said square pin non-rotatably fastened to said vertical leg, passing through a generally W-shaped slot cut through the surface of said right angle detenting bracket which is perpendicular to said shelf, said W-shaped slot terminated at each extreme in rectangular cutouts at right angles to each other, whose width is slightly greater than the width of said square pin, the central portion of said W-shaped slot having an opening of sufficient size to permit free rotation of said right angle detenting bracket and shelf about said square pin, said vertical leg maintained near parallel engagement with that face of said right angle detenting bracket which is transverse to said shelf by a washer securely fastened to said square pin ner the free end thereof, said shelf maintained in a vertical plane by that portion at one end of said W-shaped slot rectangular in shape, said shelf maintained in a horizontal plane by the other rectangular portion at the other end of said W-shaped slot, a pin transverse to said cavity traversing said cavity, said pin fastened near the ends of said track.

2. The sewing machine table accessory shelf of claim 1 wherein said shelf has a mar-proof surface.

3. The sewing machine table accessory shelf of claim 1 wherein said slide is fabricated form a plastic material having a low coefficient of friction.

4. The sewing machine table accessory shelf of claim 1 wherein said square pin is removably fastened to said vertical leg.

5. The sewing machine table accessory shelf of claim 1 wherein said track is fabricated from extruded aluminum.

* * * * *